US009427027B1

(12) United States Patent
Frierson et al.

(10) Patent No.: US 9,427,027 B1
(45) Date of Patent: Aug. 30, 2016

(54) CABLE CONTROLLING WORKOUT SHIRT

(71) Applicants: Michael E. Frierson, Los Angeles, CA (US); Diane A. Frierson, Los Angeles, CA (US)

(72) Inventors: Michael E. Frierson, Los Angeles, CA (US); Diane A. Frierson, Los Angeles, CA (US)

( * ) Notice: Subject to any disclaimer, the term of this patent is extended or adjusted under 35 U.S.C. 154(b) by 223 days.

(21) Appl. No.: 13/691,965

(22) Filed: Dec. 3, 2012

(51) Int. Cl.

| | |
|---|---|
| ***A41B 1/00*** | (2006.01) |
| ***H04R 1/02*** | (2006.01) |
| ***H04R 9/06*** | (2006.01) |
| ***A41B 1/08*** | (2006.01) |
| ***A41D 27/20*** | (2006.01) |
| ***A41D 1/00*** | (2006.01) |

(52) U.S. Cl.
CPC ..... *A41B 1/08* (2013.01); *A41D 1/002* (2013.01); *A41D 27/205* (2013.01); *A41D 27/208* (2013.01)

(58) Field of Classification Search
CPC .. A41D 1/002; A41D 1/005; A41D 13/1281; A41D 13/1236; A41D 13/1245; A41D 27/205; A41D 27/208; A41B 1/00; A41B 1/08
USPC ..... 2/83, 114, 115, 244, 247, 249, 252; 381/301, 333
See application file for complete search history.

(56) References Cited

U.S. PATENT DOCUMENTS

| | | | | |
|---|---|---|---|---|
| 4,876,724 | A * | 10/1989 | Suzuki | 381/385 |
| 6,792,124 | B2 * | 9/2004 | Tilbury et al. | 381/333 |
| 7,013,492 | B2 * | 3/2006 | Hugh et al. | 2/243.1 |
| 7,364,491 | B2 * | 4/2008 | Updyke | 450/89 |
| 7,673,348 | B2 * | 3/2010 | Williams | 2/115 |
| 8,411,891 | B2 * | 4/2013 | Del Prete | 381/333 |
| 8,613,112 | B2 * | 12/2013 | Santucci et al. | 2/69 |
| 8,634,585 | B2 * | 1/2014 | Farrell et al. | 381/384 |
| 2002/0189000 | A1 * | 12/2002 | Jordan | 2/102 |
| 2004/0083529 | A1 * | 5/2004 | Tate | 2/115 |
| 2005/0101221 | A1 * | 5/2005 | Abbey et al. | 450/1 |
| 2006/0062413 | A1 * | 3/2006 | Wehrell | 381/333 |
| 2006/0075537 | A1 * | 4/2006 | Tsai | 2/69 |
| 2007/0180596 | A1 * | 8/2007 | Shelton | 2/113 |
| 2008/0047046 | A1 * | 2/2008 | Maier | 2/102 |
| 2009/0094725 | A1 * | 4/2009 | Smith et al. | 2/69 |
| 2009/0139013 | A1 * | 6/2009 | Sapowycz et al. | 2/247 |
| 2009/0320183 | A1 * | 12/2009 | Riney | 2/250 |
| 2010/0180361 | A1 * | 7/2010 | Marois et al. | 2/252 |
| 2011/0214219 | A1 * | 9/2011 | Miller | 2/115 |
| 2012/0060260 | A1 * | 3/2012 | Kochling | 2/250 |
| 2012/0186000 | A1 * | 7/2012 | Raviv | 2/247 |

* cited by examiner

*Primary Examiner* — Alissa L Hoey
*Assistant Examiner* — Jameson Collier

(57) ABSTRACT

A cable controlling shirt system having a shirt with a front, a back, a neck area, a waist area, armholes, an interior surface, and an exterior surface. A channel patch has an upper edge, a lower edge, a first side edge, and a second side edge. The side edges are coupled to the shirt. The channel patch and the shirt form a channel with an open upper end and an open lower end. At least one pocket has an upper extent and a lower extent. Pocket stitching couples the lower extent of the pocket to the shirt at an elevation below the channel patch.

1 Claim, 3 Drawing Sheets

CABLE CONTROLLING WORKOUT SHIRT

BACKGROUND OF THE INVENTION

1. Field of the Invention

The present invention relates to a cable controlling shirt system and more particularly pertains to removably supporting an electronic device with cables and for constraining the cables while exercising, the supporting and constraining and exercising being done in a safe, convenient and economical manner.

2. Description of the Prior Art

The use of workout shirts of known designs and configurations is known in the prior art. More specifically, workout shirts of known designs and configurations previously devised and utilized for the purpose of supporting an electronic device are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a cable controlling shirt system that allows removably supporting an electronic device with cables and for constraining the cables while exercising, the supporting and constraining and exercising being done in a safe, convenient and economical manner.

In this respect, the cable controlling shirt system according to the present invention substantially departs from the conventional concepts and designs of the prior art, and in doing so provides an apparatus primarily developed for the purpose of removably supporting an electronic device with cables and for constraining the cables while exercising, the supporting and constraining and exercising being done in a safe, convenient and economical manner.

Therefore, it can be appreciated that there exists a continuing need for a new and improved cable controlling shirt system which can be used for removably supporting an electronic device with cables and for constraining the cables while exercising, the supporting and constraining and exercising being done in a safe, convenient and economical manner. In this regard, the present invention substantially fulfills this need.

SUMMARY OF THE INVENTION

In view of the disadvantages inherent in the known types of workout shirts of known designs and configurations now present in the prior art, the present invention provides an improved cable controlling shirt system. As such, the general purpose of the present invention, which will be described subsequently in greater detail, is to provide a new and improved cable controlling shirt system and method which has all the advantages of the prior art and none of the disadvantages.

To attain this, the present invention essentially comprises a cable controlling shirt system having a shirt with a front, a back, a neck area, a waist area, armholes, an interior surface, and an exterior surface. A channel patch has an upper edge, a lower edge, a first side edge, and a second side edge. The side edges are coupled to the shirt. The channel patch and the shirt form a channel with an open upper end and an open lower end. At least one pocket has an upper extent and a lower extent. Pocket stitching couples the lower extent of the pocket to the shirt at an elevation below the channel patch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cable controlling shirt system which has all of the advantages of the prior art workout shirts of known designs and configurations and none of the disadvantages.

It is another object of the present invention to provide a new and improved cable controlling shirt system which may be easily and efficiently manufactured and marketed.

It is further object of the present invention to provide a new and improved cable controlling shirt system which is of durable and reliable constructions.

An even further object of the present invention is to provide a new and improved cable controlling shirt system which is susceptible of a low cost of manufacture with regard to both materials and labor, and which accordingly is then susceptible of low prices of sale to the consuming public, thereby making such cable controlling shirt system economically available to the buying public.

Lastly, it is an object of the present invention to provide a new and improved cable controlling shirt system for removably supporting an electronic device with cables and for constraining the cables while exercising, the supporting and constraining and exercising being done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 2:
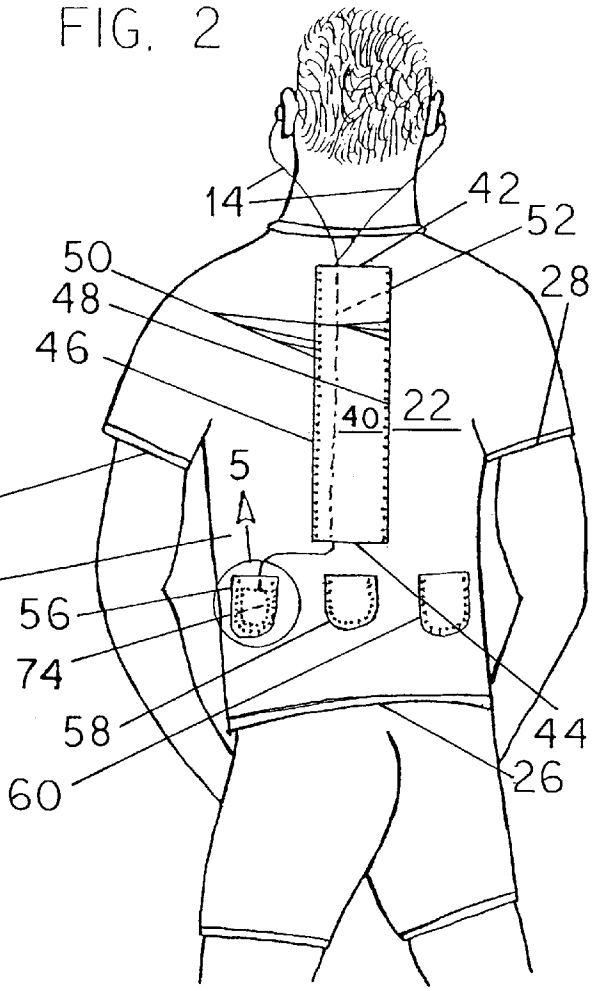
FIG. 2 is a rear elevational view of the cable controlling shirt system shown in FIG. 1.
Figure 1:
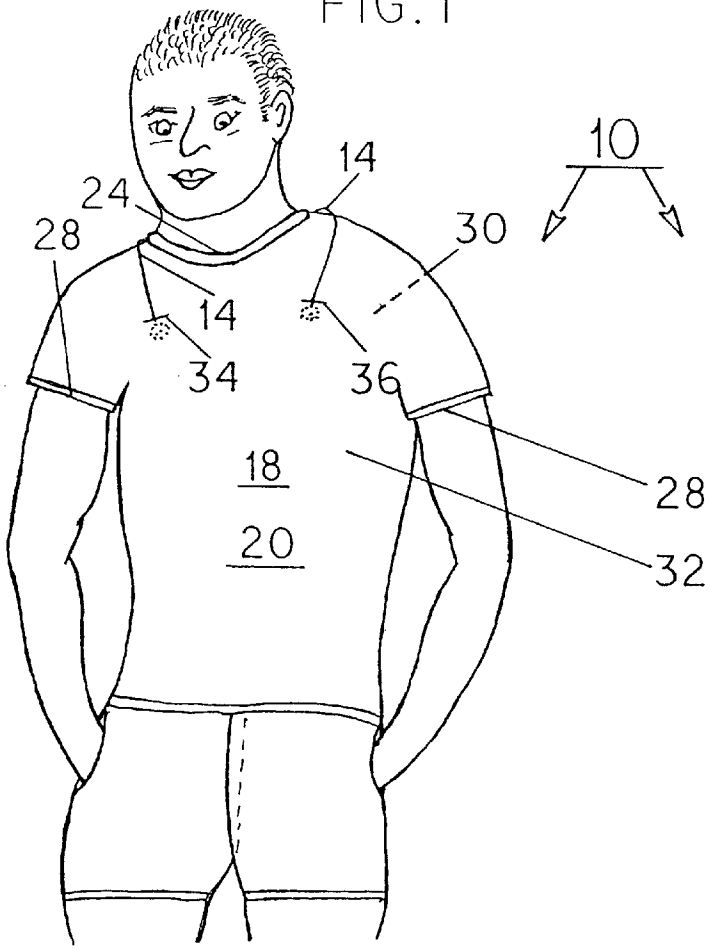
FIG. 1 is a front elevational view of a cable controlling shirt system constructed in accordance with the principles of the present invention.
Figure 4:
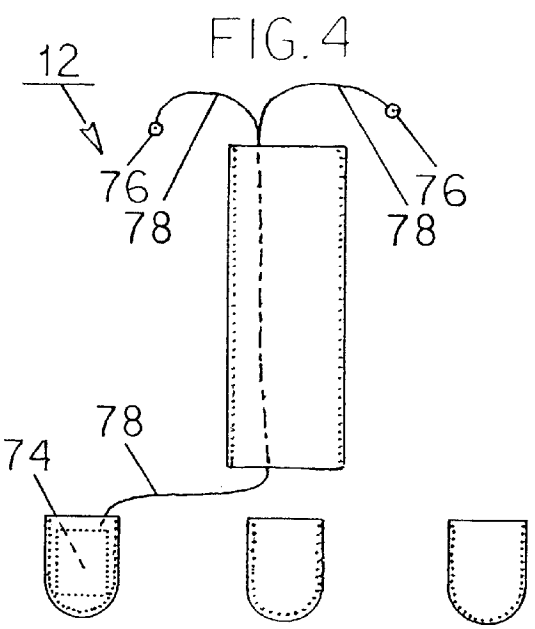
FIG. 4 is a front elevational view of the channel patch and pocket with the electronic device in place.
Figure 5:
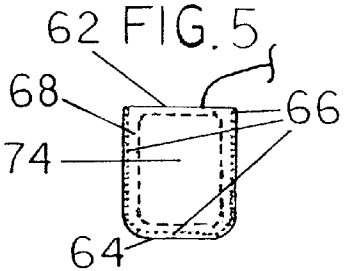
FIG. 5 is an enlarged view of the pocket with electronic device base there within taken at Circle 5 of FIG. 2.
Figure 3:
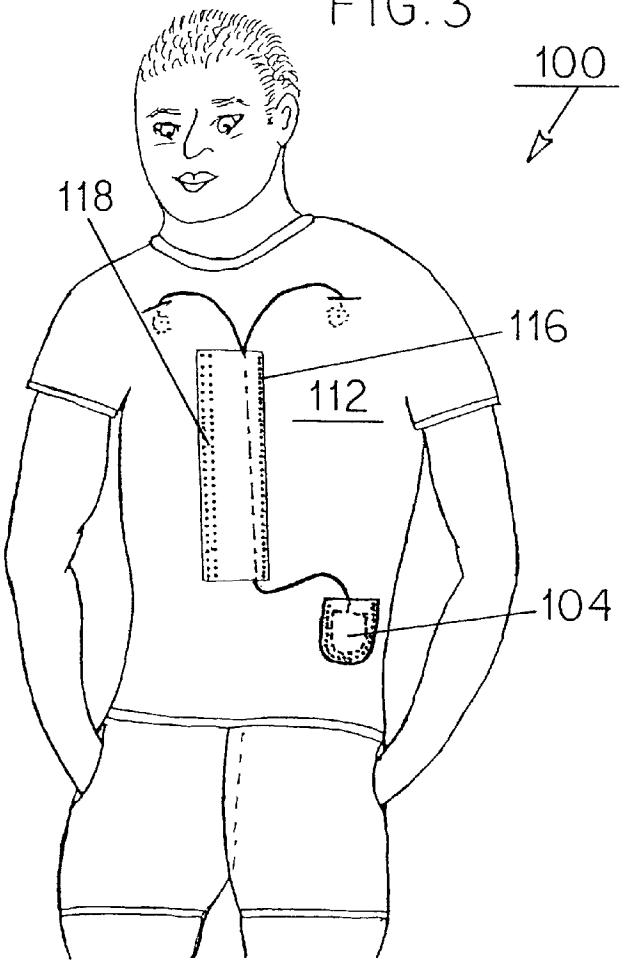
FIG. 3 is a front elevational view of a cable controlling shirt system constructed in accordance with an alternate embodiment of the invention.
Figure 9:
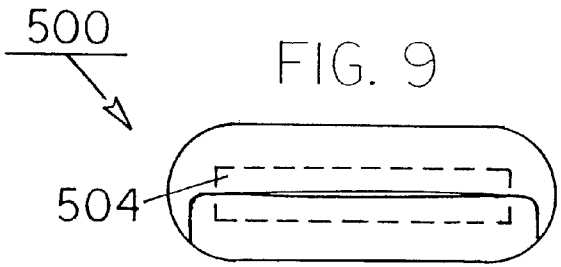
FIGS. 6-10 are enlarged showings of the top of various pockets illustrating alternate embodiments of the invention.

With reference now to the drawings, and in particular to FIG. 1 thereof, the preferred embodiment of the new and improved cable controlling shirt system embodying the principles and concepts of the present invention and generally designated by the reference numeral 10 will be described.

The present invention, the cable controlling shirt system 10 is comprised of a plurality of components. Such components in their broadest context include a garment, a channel patch, and at least one pocket. Such components are individually configured and correlated with respect to each other so as to attain the desired objective.

The cable controlling shirt system 10 is for removably supporting an electronic device 12 with cables 14 and for constraining the cables while exercising. The supporting and constraining and exercising are done in a safe, convenient and economical manner.

Next provided is a shirt 18 or other garment. The shirt is fabricated of a fabric. The shirt has a front 20 and a back 22. The shirt has a small neck opening 24 and a large waist opening 26. The armholes 28 extend laterally from an elevation adjacent to the neck opening. The shirt has a height between the neck opening and waist opening. The shirt has an interior surface 30 and an exterior surface 32. The shirt has a front centerline on the front extending vertically between the neck opening and the waist opening midway between the armholes. The shirt has a back centerline on the back extending vertically between the neck opening and the waist opening midway between the armholes. First and second slits 34, 36 are formed in the front of the shirt between the neck opening and the armholes.

Next provided is a rectangular channel patch 40. The rectangular channel patch has a horizontal upper edge 42 and a horizontal lower edge 44 separated by a height. The height of the channel patch is between 50 percent and 75 percent of the height of the shirt. The upper edge of the channel patch is located spaced beneath the neck opening. The lower edge of the channel patch is located spaced above the waist opening. The channel patch has first and second side edges 46, 48 separated by a width. The width of the channel patch is between 15 percent and 35 percent of the height of the channel patch. Channel patch stitching 50 is provided along the side edges of the channel patch attaching the channel patch to the exterior surface of the back of the shirt with the side edges on opposite sides of and equally spaced from the back centerline. The channel patch and the back of the shirt form a channel 52 with an open upper end and an open lower end.

Next, a plurality of similarly configured first and second and third pockets 56, 58, 60 are provided. Each pocket has a horizontal upper extent 62 and a U-shaped lower extent 64. Pocket stitching 66 couples the lower extents of the pockets to the back of the shirt at an elevation below the channel patch. The second pocket is located over the back centerline. The first and third pockets are laterally spaced from and on opposite sides of the second pocket. The first and third pockets are laterally spaced closer to the front of the shirt than to the back centerline. Water-proof plastic inserts 68 are provided lining each pocket.

A small electronic device 12 is next provided. The small electronic device has a base unit 74, ear buds 76 and cables 78. The cables couple the ear buds and the base unit. The base unit is removably positioned in a preselected one of the plurality of pockets. The ear buds are selectively positioned in ears of a wearer during use and in the first and second slits when not in use. The cables are located in the channel to preclude interfering with the wearer when exercising.

In an alternate embodiments of the invention, the system 100 has at least one pocket 104 located on the front 112 of the shirt. In this embodiment, the channel patch is coupled to the shirt with stitching 116 along the first edge and a hook and loop fastener 118 along the second edge.

Alternate embodiments of the invention are shown in FIGS. 6 through 10. In the alternate embodiment of the system 200 shown in FIG. 6, the upper extent of the at least one pocket includes a zipper 204 for selectively closing the pocket when containing an electronic device.

Figure 7:
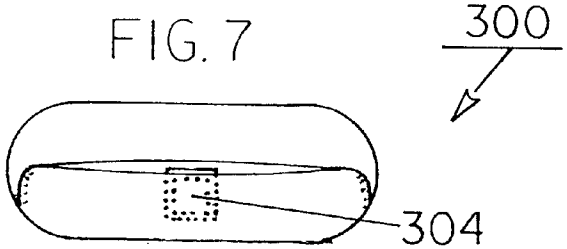

In the embodiment of the system 300 shown in FIG. 7, the upper extent of the at least one pocket includes a pile type fastener 304 for selectively closing the pocket when containing an electronic device.

Figure 8:
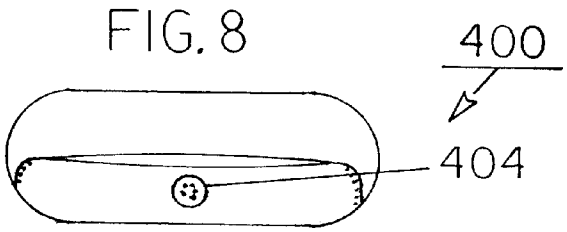

In the embodiment of the system 400 shown in FIG. 8, the upper extent of the at least one pocket includes a snap fastener 404 for selectively closing the pocket when containing an electronic device.

Figure 10:
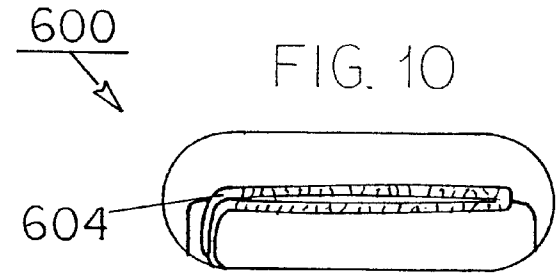
Figure 6:
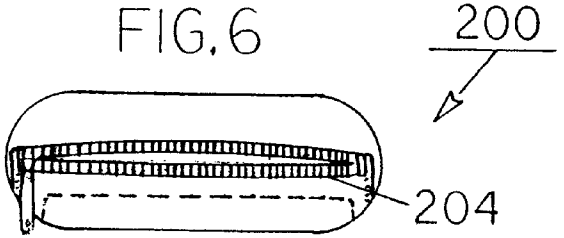

In the embodiment of the system 500 shown in FIG. 10, the upper extent of the at least one pocket includes a magnet 504 for selectively closing the pocket when containing an electronic device.

Lastly, in the embodiment of the system 600 shown in FIG. 10, the upper extent of the at least one pocket includes a draw string 604 for selectively closing the pocket when containing an electronic device.

The design and function of this cable controlling shirt is to control audio cables when using any compact electronic device including any MP3 player, any cell phone or any Apple iPod product. The channel design will help the wearer of the shirt to maintain control of the audio cable while keeping his/her hands free from adjusting the cables while listening to any compact electronic device. While many types of sports shirts are currently available, none have a method of keeping the audio cables from sticking to a wearer's back, or getting in the way of the hands or arms of the wearer. The cable controlling shirt design was created to maintain the audio cables in a neutral position. We define neutral position as the cable running parallel to the spine of the human body. With this design, the wearer will not pull the audio cables around his/her hands or arms. Also, the cables will not be pulled out of the ears of the wearer, or disengaged from the compact electronic device.

The design of this shirt will have a single channel or multiple channels that will guide the audio cable from the top of the shirt, vertically down the center of the back or front of the shirt. The bottom of the shirt will have a pocket to hold any compact electronic device. The pocket can be located anywhere on the shirt.

This design can be used on any type of shirt or jacket or wind-breaker or the like. Examples of the types of shirts that can be used in this design are: golf shirts, collared shirts, non-collared shirts, short or long sleeve shirts, dry-fit athletic shirts, yoga tops, polo shirts, and, as technology allows when audio devices are made waterproof, on swimsuits.

This shirt will have the ability to be used for a variety of activities. This design relates generally to sports garments, but not exclusively. Some proposed wearers of the shirt would be: golfer, basketball players, baseball players, police officers, doctors for surgical scrubs, skateboarders, skiers, yoga participants, people working out at a gym, runners, walkers, or anyone that wants to maintain a hands free session of activity.

The channel patch will be sewn onto the back or front of the shirt. The channel will be between 8 to 11 inches in length running down the back of the shirt, and approximately 2.25 to 4 inches in width. There will be an opening adjacent to the bottom of the channel. There will be a pocket at the bottom of the channel, the dimensions will be 0.5 inch to 4 inches in width. This pocket will be used to hold any compact electronic device. The pocket can be located anywhere on the shirt.

The design will be such that the channel will run vertically down the middle of the back or vertically down the middle of the chest with a pocket just below. Or the channel will run vertically down the middle of the back or vertically down the middle of the chest, pockets will be located on the left or right side of the shirt. These pockets will be used to hold any compact electronic device.

The shirt will have two small, one inch, slits, one on the left and one on the right, in the front of the shirt to hold the ear buds, when necessary. The slits will be approximately 5 inches down from the front shoulder seams of the shirt.

The design of the channels can be in any color or texture or fabric that will allow the cables to drop down thru it. A plastic insert will be built into the bottom pocket in order for it to be waterproof and to be firm enough to hold the audio device. The pocket at the bottom of each channel will close via a zipper, or piece of pile type fastener, or a snap, or a magnet, or a draw string so that the compact electronic device will not come out of the top of the pocket.

Although the disclosed embodiments illustrate a rectangular piece of fabric creating the channel, it should be understood that such piece of fabric could take a variety of shapes including curves. Further, instead of being of a single piece, it could be a plurality of adjacent components to achieve the same function.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cable controlling shirt system (10) for removably supporting an electronic device (12) with cables (14) and for constraining the cables while exercising, the supporting and constraining and exercising being done in a safe, convenient and economical manner, the system comprising, in combination:

a shirt (18) fabricated of a fabric, the shirt having a front (20) and a back (22), the shirt having a small neck opening (24) above and a large waist opening (26) below and armholes (28) extending laterally from an elevation adjacent to the neck opening, the shirt having a height between the neck opening and waist opening, the shirt having an interior surface (30) and an exterior surface (32), the shirt having a front centerline on the front extending vertically between the neck opening and the waist opening midway between the armholes, the shirt having a back centerline on the back extending vertically between the neck opening and the waist opening midway between the armholes, laterally spaced first and second slits (34)(36) formed in alignment in the front of the shirt between the neck opening and the armholes;

a rectangular channel patch (40) the rectangular channel patch having a horizontal upper edge (42) and a horizontal lower edge (44) separated by a height, the height of the channel patch being between 50 percent and 75 percent of the height of the shirt, the upper edge of the channel patch being located spaced beneath the neck opening, the lower edge of the channel patch being located spaced above the waist opening, the channel patch having first and second side edges (46)(48) separated by a width, the width of the channel patch being between 15 percent and 35 percent of the height of the channel patch, channel patch stitching (50) along the side edges of the channel patch attaching the channel patch to the exterior surface of the back of the shirt with the side edges on opposite sides of and equally spaced from the back centerline, the channel patch and the back of the shirt forming a channel (52) with an open upper end and an open lower end;

a plurality of similarly configured first and second and third pockets (56)(58)(60), each pocket having a horizontal upper extent (62) and a U-shaped lower extent (64), pocket stitching (66) coupling the lower extents of the pockets to the back of the shirt at an elevation below the channel patch, the second pocket being located over the back centerline, the first and third pockets being laterally spaced from and on opposite sides of the second pocket, the first and third pockets being laterally spaced closer to the front of the shirt than to the back centerline, water-proof plastic inserts (68) lining each pocket;

a small electronic device (12), the small electronic device having a base unit (74), ear buds (76) and cables (78), the cables coupling the ear buds and the base unit, the base unit removably positioned in a preselected one of the plurality of pockets, the ear buds selectively positioned in ears of a wearer during use and in the first and second slits when not in use, the cables being located in the channel to preclude interfering with the wearer when exercising.

* * * * *